US005768135A

United States Patent [19]

Park et al.

[11] Patent Number: 5,768,135

[45] Date of Patent: Jun. 16, 1998

[54] CUSTOM APPAREL MANUFACTURING APPARATUS AND METHOD

[75] Inventors: Sung K. Park, Jamaica Plain; Bethe M. Palmer, Marblehead; Gerald S. Ruderman, Wellesley, all of Mass.

[73] Assignee: Custom Clothing Technology Corporation, Newton, Mass.

[21] Appl. No.: 635,008

[22] Filed: Apr. 19, 1996

Related U.S. Application Data

[63] Continuation-in-part of Ser. No. 289,406, Aug. 12, 1994, Pat. No. 5,448,519.

[51] Int. Cl.[6] ..... G06F 19/00

[52] U.S. Cl. ..... 364/470.01; 364/470.05; 364/470.06; 364/470.07; 364/470.08

[58] Field of Search ..... 364/470.1, 470.01, 364/188, 468.29, 469.04, 189, 470.06, 469, 470.05, 470.07, 470.08; 395/545, 50, 68, 54

[56] References Cited

U.S. PATENT DOCUMENTS

| | | | |
|---|---|---|---|
| 358,903 | 3/1887 | Weir | D26/110 |
| 633,654 | 9/1899 | Melick | 33/15 |
| 1,121,410 | 12/1914 | Scribante | 33/15 |
| 1,732,369 | 10/1929 | Leeman | 33/16 |
| 2,231,437 | 2/1941 | Cieri | 33/15 |
| 2,374,654 | 5/1945 | Cooke | 33/15 |
| 2,615,250 | 10/1952 | Fessler | 33/15 |
| 2,631,374 | 3/1953 | Purdy | 33/2 R |
| 2,762,124 | 9/1956 | Angelo | 33/16 |
| 3,091,861 | 6/1963 | Jones | 33/15 |
| 3,391,392 | 7/1968 | Doyle | 364/561 |
| 3,529,298 | 9/1970 | Lourie | 364/470.02 |
| 3,566,365 | 2/1971 | Rawson | 395/604 |
| 3,601,817 | 8/1971 | Abrams | 2/227 |
| 3,765,349 | 10/1973 | Gerber | 112/121.14 |
| 3,766,528 | 10/1973 | Ichida | 33/15 |
| 3,887,903 | 6/1975 | Martell | 340/172.5 |
| 3,895,358 | 7/1975 | Pearl | 340/172.5 |
| 3,902,182 | 8/1975 | Hillborg | 354/105 |
| 4,136,452 | 1/1979 | McMillan | 33/12 |
| 4,137,634 | 2/1979 | Klamar | 364/468 |
| 4,149,246 | 4/1979 | Goldman | 364/200 |
| 4,211,011 | 7/1980 | Jacobson | 33/15 |
| 4,546,434 | 10/1985 | Gioello | 364/300 |
| 4,586,150 | 4/1986 | Budziak | 364/562 |
| 4,598,376 | 7/1986 | Burton | 364/470 |
| 4,635,367 | 1/1987 | Vigede | 33/17 R |
| 4,677,564 | 6/1987 | Paly et al. | 364/468 |
| 4,868,990 | 9/1989 | Steinberg | 33/15 |
| 4,873,643 | 10/1989 | Powell et al. | 364/513 |
| 4,885,844 | 12/1989 | Chun | 33/15 |
| 4,905,159 | 2/1990 | Loriot | 364/470 |
| 4,916,624 | 4/1990 | Collins et al. | 364/470 |
| 4,916,634 | 4/1990 | Collins et al. | 364/470 |
| 4,926,344 | 5/1990 | Collins et al. | 364/513 |
| 4,995,514 | 2/1991 | Forschner | 206/574 |
| 5,163,006 | 11/1992 | Deziel | 364/470 |
| 5,163,007 | 11/1992 | Slilaty | 364/470 |
| 5,313,902 | 5/1994 | Shoji | 112/454 |
| 5,341,305 | 8/1994 | Clarino et al. | 364/470 |
| 5,364,701 | 11/1994 | Boles et al. | 428/373 |
| 5,548,519 | 8/1996 | Park et al. | 364/474.06 |

FOREIGN PATENT DOCUMENTS

| | | |
|---|---|---|
| 0 537 388 A1 | 4/1993 | European Pat. Off. . |
| 0537388 A1 | 4/1993 | European Pat. Off. . |

*Primary Examiner*—Joseph Ruggiero
*Assistant Examiner*—R. Patel
*Attorney, Agent, or Firm*—Medlen & Carroll, LLP

[57] ABSTRACT

The present invention is a system and method for custom tailoring and manufacturing apparel by using numerous try-on apparels of differing, predetermined dimensions to make a finished product. A system is used to keep track of the number of try-on apparels and each of their dimensions. As a consumer tries on one of these try-on apparels, a device associated with the system is used to collect the consumer's responses about fit. If one try-on apparel does not fit, the system suggest a next one to try, according to pre-defined rules. When a particular try-on apparel's fit has been approved for purchase by the consumer, this is reported to a manufacturing system, where a piece of apparel corresponding to the dimensions of the approved try-on apparel is cut, stitched, treated, and shipped as a finished apparel.

20 Claims, 16 Drawing Sheets

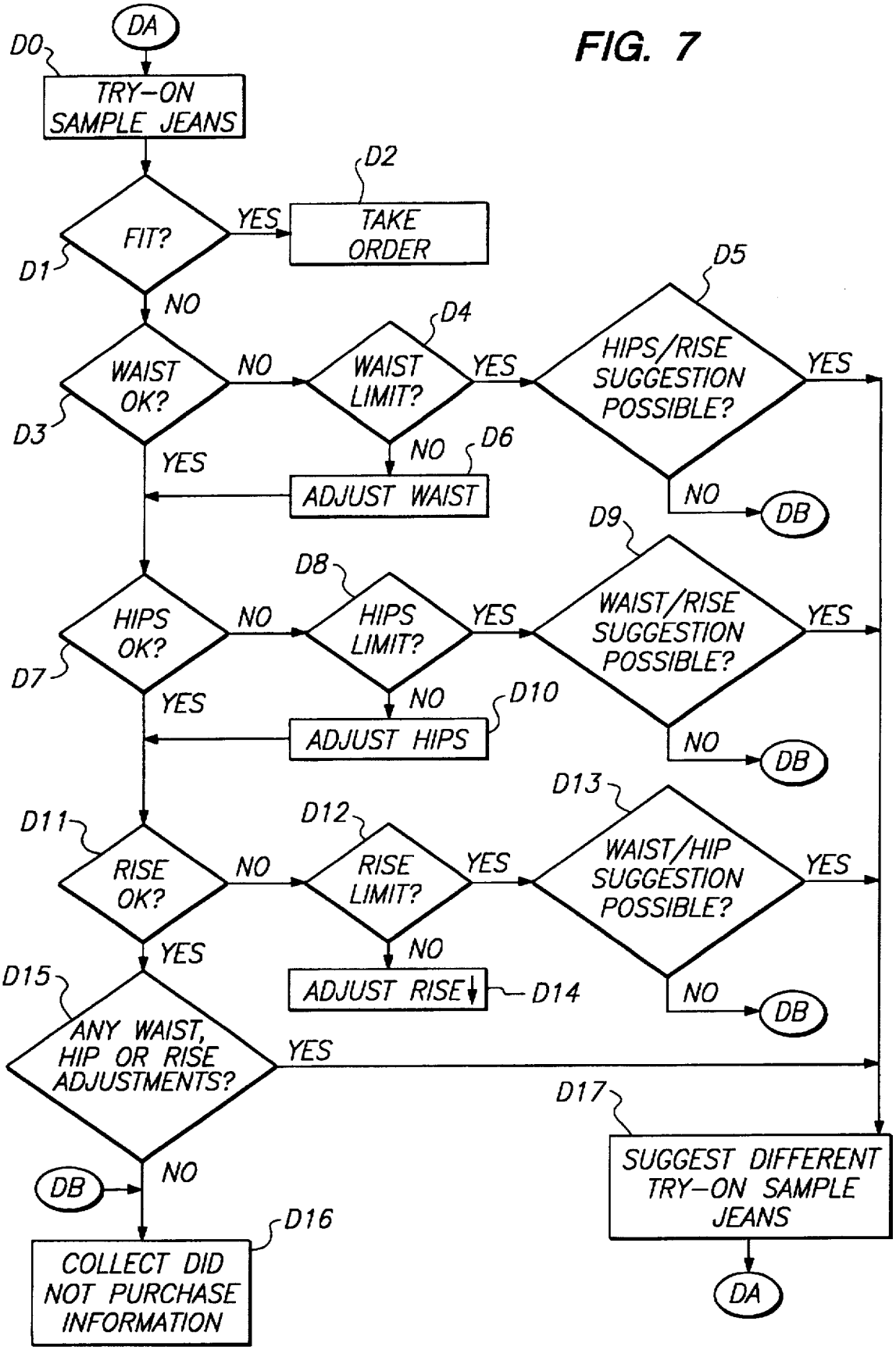
FIG. 7
DA
D0
TRY-ON SAMPLE JEANS
D1
FIT?
YES
D2
TAKE ORDER
NO
D3
WAIST OK?
NO
D4
WAIST LIMIT?
YES
D5
HIPS/RISE SUGGESTION POSSIBLE?
YES
NO
DB
NO
D6
ADJUST WAIST
YES
D7
HIPS OK?
NO
D8
HIPS LIMIT?
YES
D9
WAIST/RISE SUGGESTION POSSIBLE?
YES
NO
DB
NO
D10
ADJUST HIPS
YES
D11
RISE OK?
NO
D12
RISE LIMIT?
YES
D13
WAIST/HIP SUGGESTION POSSIBLE?
YES
NO
DB
NO
ADJUST RISE
D14
YES
D15
ANY WAIST, HIP OR RISE ADJUSTMENTS?
YES
NO
DB
D16
COLLECT DID NOT PURCHASE INFORMATION
D17
SUGGEST DIFFERENT TRY-ON SAMPLE JEANS
DA

CUSTOM APPAREL MANUFACTURING APPARATUS AND METHOD

RELATED APPLICATION DATA

This is a continuation-in-part of U.S. patent application Ser. No. 08/289,406 filed on Aug. 12, 1994, now U.S. Pat. No. 5,548,419.

FIELD OF THE INVENTION

This invention relates generally to the custom manufacturing of fitted apparel and more particularly to an apparatus and method for manufacturing custom tailored apparel using multiple try-on apparels and a fitting system.

BACKGROUND OF THE INVENTION

For years, a basic problem in making fitted apparel in a cost effective manufacturing system has been determining how to capture a person's body dimensions so that a piece of clothing can be constructed to fit that person well and without undue expense for the manufacturer, retailer or consumer. Apparel designed for three-dimensional objects such as a human body, can be complex to make, since changes in one dimension, such as rise or waist, in the case of pants, may require changes in hip dimensions in order to insure a fit.

Many consumers, particularly women, have trouble finding volume manufactured or ready-made apparel such as blue jeans, that fit to their satisfaction. One cause of this is that the traditional sizing system for women used by volume manufacturers is essentially a single dimensional one developed in 1941. Based on statistical averages, this sizing system results in sizes represented as one abstract dimension, such as size 6 or size 8. Minor variations of this have been added, over time to permit petite or plus sizes, still with one abstract dimension within the petite or plus size subclass, such as size 6 petite or size 6 long or short. Sizes in men's apparel such as pants, shirts and suits are not much different, although shirt sizes may be stocked by neck or arm length dimensions and a few combinations of standard sizes. Generally speaking, the same is true for most other types or configurations of apparel such as footwear, gloves, coats, dresses and so on. While it is theoretically possible to stock a large number of varying standard sizes, to offer more options to a consumer, the costs of maintaining large inventories make that prohibitive. Consequently, only a few standard sizes are offered in most retail stores for consumers.

Nevertheless, in just the simple case of women's pants, there are literally thousands of combinations of waist, hips, rise and inseam measurements that are possible for a pair of blue jeans if a large population is to be fitted. Only one particular combination is likely to be a good fit for any given person. If any one of a person's dimensions are different from the statistical averages, fitting will be harder. If waist size is narrower than the average or the customer desires pants having a shorter rise, it will be difficult to get a good fit from ready-to wear clothing.

In a sample of 500 women measured in a survey, only 11 of the 500, or about 2%, had exact matches to the industry standard sizes.

Hence, many consumers reject ready-to wear and turn to custom fitted clothing. In order to make something custom fit, one must capture key body dimensions, then construct a garment or apparel. Four traditional ways have been used in the past to accomplish this:

1. Use a tape measure to measure the person for key dimensions, and then use those dimensions to build the garment.

2. Place the actual garment that the consumer will wear on the person and make tailoring adjustments to that garment.
3. Use an adjustable garment to capture body dimensions.
4. Use some sort of mechanical, optical or video device to capture body dimensions.

The first two approaches used together constitute classical custom tailoring. While generally producing a good fit, the skilled labor of the tailor or seamstress required for traditional custom tailoring makes it too costly for manufacturers and retailers of ready to wear clothing to use, and too expensive for many consumers.

Adjustable try-on garments or patterns are known in the art and have been used to address the problem. This may also require skilled labor at the retail site, in order for adjustments to be made properly. Whether only one adjustable garment is used or even several adjustable garments in the standard sizes, a considerable amount of labor and expense also remains in the cutting and manufacturing side, since each garment must be uniquely cut to the dimensions adjusted on each customer. The use of computers can speed up the collection of the information that needs to be transmitted about the adjustments to be made, but the unique cutting requirements are still costly and time-consuming. Even where computers are used to create a scaled pattern based on actual measurements, the costs and time for uniquely cutting to those dimensions usually remain significant.

Materials such as denim, leather, vinyl or fur or others that are difficult to work with, complicate the problem further. If the garment is not cut satisfactorily the first time, it may be prohibitively expensive to adjust it to fit if the customer is dissatisfied with the fit of the actual garment.

Hence, other attempted improvements in the area stem from the use of optical or electrical sensors and a computer to improve accuracy of the measurements. In this type of scheme, the optical or electronic device is used to sense and capture the measurements of a person's body. In one system, the individual wears a special garment having measuring devices that can be "read" by the system. This can be combined with a computer system such as one which creates or scales a special pattern based on such readings. Thus, the measurements can be taken or made interactively and accurately, but each garment must still be cut to the unique dimensions so ascertained.

While this improves accuracy and collection of the custom information, it, too, does not solve the remaining problems and costs of unique cutting and assembly facing the volume manufacturer. Volume manufacturers may make as many as 60,000 or 70,000 pairs of pants a week in factories around the world. Costs have typically been kept low with the use of uniform sizes, which lowers or eliminates the need for specially skilled labor, and specialized, unique cutting and tracking. Custom tailoring done according to the traditional methods is inconsistent with high volume manufacturing and low costs.

Finally, there is a significant subjective element to a sense or feel of fit that varies from customer to customer. For example, two customers whose measurements are exactly the same, may have different tastes regarding looseness or tightness of fit, with one preferring a looser garment and the other a tighter garment. Or, two customers with identical measurements could differ in their style preferences, with one preferring to wear a pair of denim jeans low on the hips and the other higher. In order to conform to a customer's subjective preferences, one or more of the other dimensions may need to be adjusted since they are interrelated. If only objective measurements are used for the custom garment without an actual fitting, these subjective elements may frequently cause a garment constructed only from objective data to be returned by the consumer. A high return or reject rate is costly for both retailers and manufacturers.

SUMMARY OF THE INVENTION

The present invention is a system and method for custom tailoring and manufacturing apparel by using numerous try-on apparels of differing, predetermined dimensions to make a finished product. A system is used to keep track of the number of try-on apparels and each of their dimensions. As a consumer tries on one of these try-on apparels, a device associated with the system is used to collect the consumer's responses about fit. If one try-on apparel does not fit, the system suggests a next one to try, according to pre-defined rules. When a particular try-on apparel's fit has been approved for purchase by the consumer, this is reported to a manufacturing system, where a piece of apparel corresponding to the dimensions of the approved try-on apparel is cut, stitched, treated, and shipped as a finished apparel.

It is an object of the present invention to provide a method and apparatus for producing custom fitting apparel in volume without the higher costs of traditional custom methods. Apparel manufactured according to the method and apparatus of the present invention can be constructed in volume from one of numerous pre-determined dimensions corresponding to the approved, pre-determined dimensions of a try-on apparel actually selected and tried by a customer.

It is a further object of the present invention to provide retailers and stores with an easily used system for collecting fit information to identify a particular approved try-on apparel to be manufactured and purchased.

It is a feature of the present invention that it allows customers to actually try an apparel on for fit and feel before a custom order is placed.

It is an aspect of the present invention that it permits a manufacturer of custom apparel to optimize use of materials by providing pre-determined dimensions that can be used to cut and manufacture finished apparel. Layouts for the various dimensions can be selected in advance to insure optimal use of fabric, for example, while still providing custom fitting.

It is another aspect of the present invention that it can be implemented in a number of types of systems, from simple manual or electronic devices to computerized systems.

Yet another feature of the invention is its ability to collect approved fit information by customer and convey it to remote manufacturing sites. Using the pre-determined dimensions, or codes corresponding to them, together with ordering and shipping information a retailer can fill orders quickly for items not carried in inventory.

Still another feature of systems constructed according to the present invention is that they use expert system rules. As new types of apparel are considered for manufacture, such as shirts or footwear, for example, rules appropriate to fitting them can be developed and implemented.

BRIEF DESCRIPTION OF THE DRAWINGS.

FIG. 7 is a flowchart of the principal logic of a system constructed according to the present invention.

DETAILED DESCRIPTION OF A PREFERRED EMBODIMENT(S)

Figure 1:
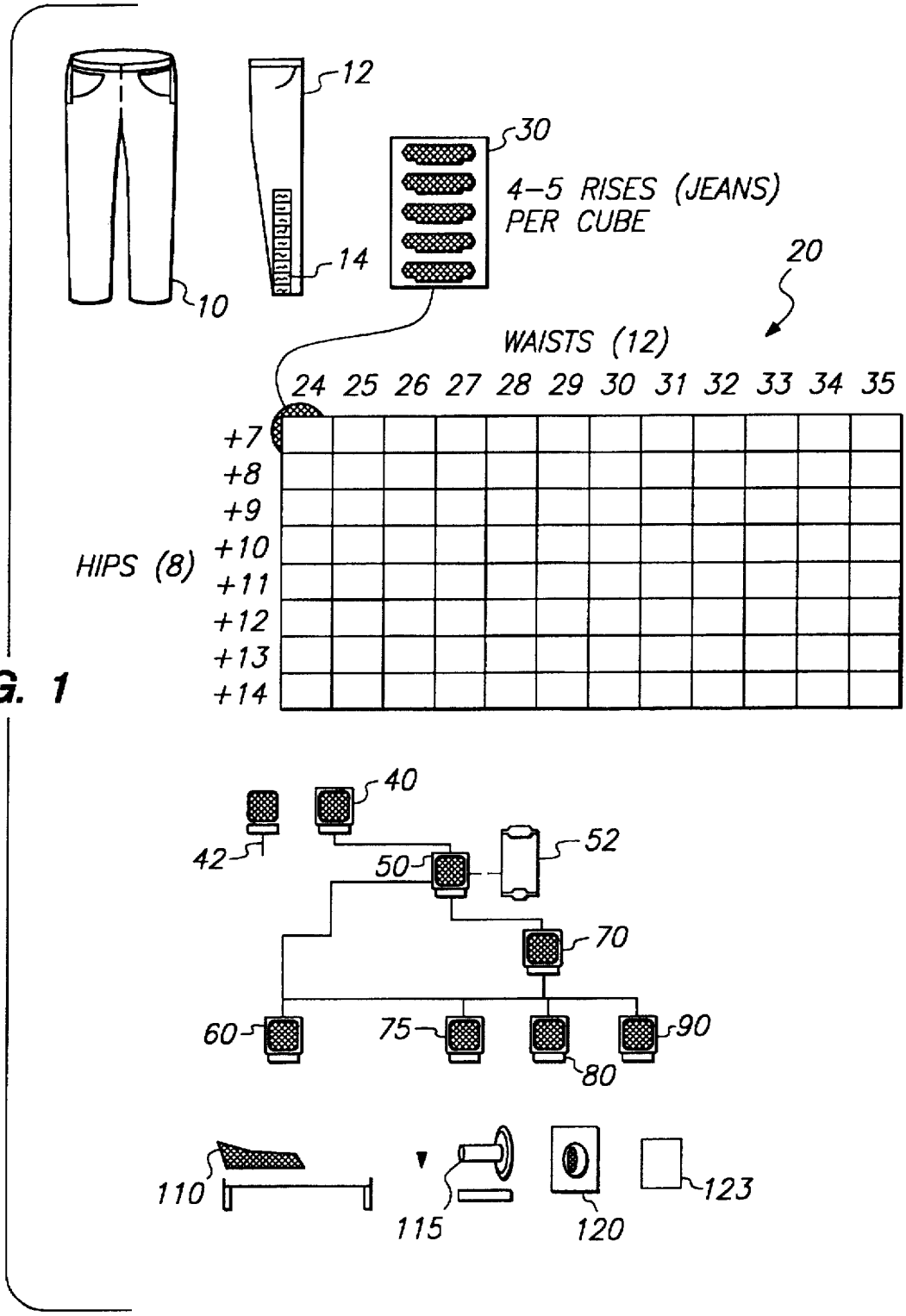
FIG. 1 is an illustrative front and side view of a try-on apparel, shelves containing numerous other try-on apparels, and a system for storing information about them for transmission to a manufacturing system, according to the present invention.

In FIG. 1, a try-on apparel 10 is shown in the form of a pair of women's jeans. As will be apparent to those skilled in the art, any of a number of different types of apparel such as apparel for humans or pets or fitted coverings for furniture or other objects capable of significant variations in dimensions can be made according to the method and apparatus of the present invention.

A side view 12, is shown of try-on apparel 10, bearing a measuring device 14. In a preferred embodiment of the present invention, a considerable number of try-on apparels 10, each having different dimensions from the others are kept at a retail store or site in containers or racks such as shelves 20. For ease of access, each cube 30 of shelves 20 contains a specific number of try-on apparels 10. Here, five different try-on apparels 10 are shown in a cube 30. In this example, nearly 500 try-on apparels, each having dimensions from each of the others are used. In a preferred embodiment, these are not ordinarily used as goods inventory, but are reserved for try-ons. Each try-on apparel 10 is marked to identify it and to enable a user to distinguish it from all other try-on apparels. The marking is most preferably provided in the form of a label bearing a computer readable form, such as a scannable bar code. Alternatively, a marking could be made directly on the try-on apparel fabric, preferably by using a washable marking if the try-on garment so marked is intended to be sold to a consumer for wear. This marking can conveniently contain information regarding the dimensions of the marked try-on garment, or coding corresponding to a stored pattern which can be used to recreate a garment having the exact dimensions of the try-on garment.

The try-on garments must fit a wide variety of body shapes. Normal grading processes produce ill-fitting garments at the extremes of size ranges (e.g., very small and very large garments produced using normal grading processes can be ill-fitting). We prefer to use a double-grading process to create the pattern grid from which the try-on garments and customer garments are constructed. In the double-grading process key grade points are identified and held constant while normally grading the rest of the garment. For example, when producing base patterns for trouser, we find the key grade point is the waist. This is held constant, while grading the rest of the garment. The resulting pattern then become the base pattern for a normal grading process used to create other patterns. The resulting double-graded patterns can be used to create garments that fit better.

In a preferred embodiment, try-on apparels 10 can be stored in shelves 20 according to gradations in sizes of their dimensions. For example, for women's pants, try-on apparels 10 having a waist size of 24 can be stored in the first column of shelves 20, with each cube 30 holding 5 pairs of the same hip size. Hip sizes increase incrementally by a predefined increment, for example, in jeans by an inch for each cube 30 of five try-on apparel 10. Within a cube 30, try-on apparels 10 having five different rise measurements are kept for each particular waist/hip combination in this example. As will be shown, a method of the present invention is used to determine the number of try-on apparels 10 to be made for a store, together with their dimensions for a selected design and configuration of apparel such as women's jeans.

Figure 2:
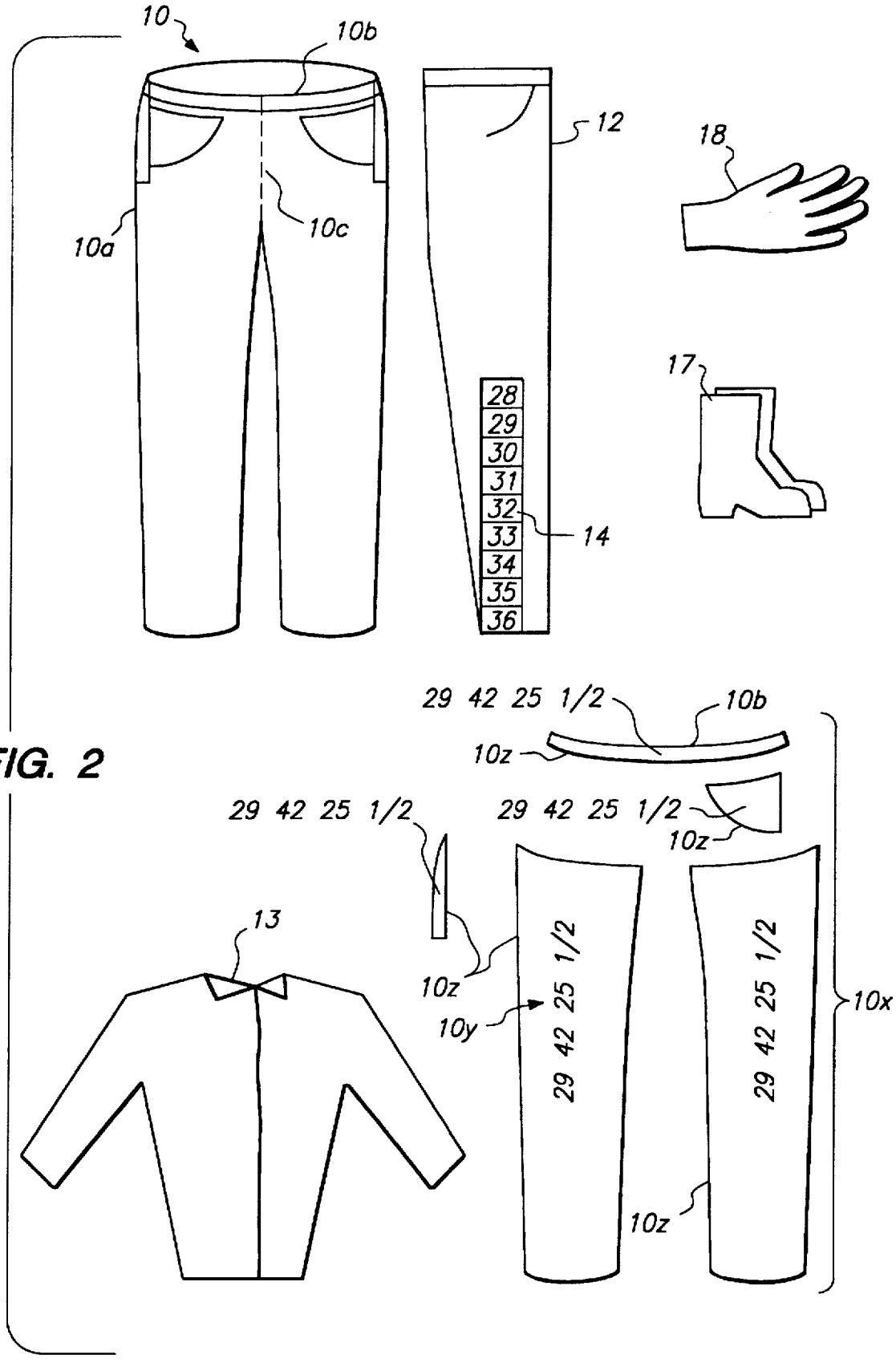
FIG. 2 is a schematic drawing illustrating some types of apparel that can be made using the present invention.

As shown in FIG. 2, and as noted above, try-on apparels can, in some instances, be provided with a measuring tape 14 attached along one or more dimensions to enable the easy measurement of a variable dimension. This is particularly useful in measuring length-dependent dimensions, such as, for example, inseam length in trousers, sleeve length in shirts, and hem length in skirts, and reduces the total number of try-on garments which might otherwise be required.

As shown in FIG. 1, system 40 is used within a retail store to store the dimensions of, or other information identifying, predetermined patterns corresponding to each of the try-on apparels 10 in shelves 20. Additional systems or terminals 42 can be used as well. The patterns, and their corresponding try-on garments, form a grid of incrementally changing critical dimensions. For example, in trousers, the critical dimensions forming the grid are the waist, hips and rise. This forms a three dimensional grid of patterns which vary by predetermined increments.

While preferable, it is not necessary to provide a try-on garment for each pattern stored in the system 40. The number of try-on garments can be reduced, without significantly reducing the ability to identify the best-fitting pattern, so long as a sufficient number of try-on garments are provided. For example, it would be possible to provide try-on garments for every other incremental change in a critical dimension, instead of for every incremental change. In this situation, if a customer were looking for an appropriate fit in a pair of jeans and all dimensions except the waist were acceptable, if the waist dimension on one try-on garment was slightly too small and the waist dimension on the next larger try-on garment was slightly too large, the system would select the pattern having a waist dimension which was in between the first and second try-on garment.

According to the method and apparatus of the present invention, the customer's critical measurements are taken. As noted above, for example, if the garment being fitted is trousers, the critical initial measurements are waist, hips and rise. These critical measurements can be taken with any appropriate measuring device, but more preferably are taken with an automatic digital tape measuring device which can be linked to system 40 for automatic entry of measurements. An example of such a device is found in U.S. Pat. No. 5,691,923 which issued Nov. 25, 1997, which is incorporated herein by reference. Such a device is beneficial because it substantially reduces the possibility of erroneous data entry and because it is easy for an unskilled worker to use.

The initial measurements are entered into the system 40 which selects the closest-fitting try-on apparel 10 for the customer to try on. The customer tries on the selected try-on apparel 10, and reports fit information to a clerk for entering into system 40. For example, if trying on jeans where the critical dimensions are waist, hips and rise, the customer might report that the waist is too small, but the hips and rise are fine. The system 40 then can look in the grid for the try-on garment having the same hips and rise, but the next incrementally larger waist measurement. This next try-on apparel 10 is recommended and tried on by the customer. The process of entering customer feed back/preferences into the system 40 and identifying another try-on garment are repeated until fit has been approved by the customer. For garments having one or more variable dimensions measured by a built-in measuring device such as tape measure 14, as shown in FIG. 1, the appropriate length measurement can be determined by adjusting length of the appropriate portion of the garment according to customer preference and reading the measurement from the tape. Hook and loop type fasteners, such as Velcro® fasteners, can be used to secure an end of the garment at an appropriate position so that the customer can view the adjusted length of the garment portion to determine if the selected length is satisfactory. The measured dimension can then be entered into the system 40 which preferably identifies the pattern having the desired length, or alternatively scales the pattern to the appropriate length. Fit approval can be indicated to system 40 and further conveyed to a server 50, having network and other address information stored on disks or other storage devices 52. The exact dimensions of the pattern corresponding to try-on apparel 10 approved by the customer can then be transmitted on to cutter controller 60 at a manufacturing facility, or to a pattern printer (not shown) for the generation of a paper pattern.

In one preferred embodiment, cutter controller 60 will contain information about pre-defined patterns for cutting parts of fabric according to the exact dimensions of try-on apparel 10 approved by the customer. Once cut, the fabric can be tracked by manufacturing system 70. Manufacturing system 70 may include several subsystems, such as QA (quality assurance) tracking system 80 and shipping system 90. After cutting, the fabric may be stitched at stitching station 110, treated at treatment station 120, packaged at station 123 and then shipped to the retail store or directly to the customer by shipping system 90.

Turning now to FIG. 2, some types of try-on apparel 10, are shown. Try-on apparel 10 is shown here as a pair of women's jeans, having predetermined hip 10*a*, waist 10*b* and rise 10*c* dimensions. In a preferred embodiment, rise is measured as the distance between the crotch and the waist of a pair of pants or jeans, from front to back. If the rise is shorter, the waist will sit lower on the wearer. If the rise is higher, the waist will be higher on the wearer.

Still in FIG. 2, an apparel of another type of configuration is depicted as shirt 13. Similarly, footwear such as boots 17 or other fitted apparel such as gloves 18 can be made according to the method and apparatus of the present invention.

Again in FIG. 2, a pattern 10*x* is shown having several parts or workpieces, 10*z*. Each part can be marked with a code 10*y* which corresponds to the same dimensions as a particular try-on apparel 10. As noted above for the try-on garments, the code marked on the pattern parts can be provided on a label or marked directly on the pattern parts, and the code itself can comprise a computer readable marking such as a scannable bar code. Also in FIG. 2, a side view 12 of try-on apparel 10 is shown, with a measuring device 14 attached to an outer leg. In a preferred embodiment, device 14 is marked with the allowable dimensions for an inseam length for a pair of jeans.

Figure 3:
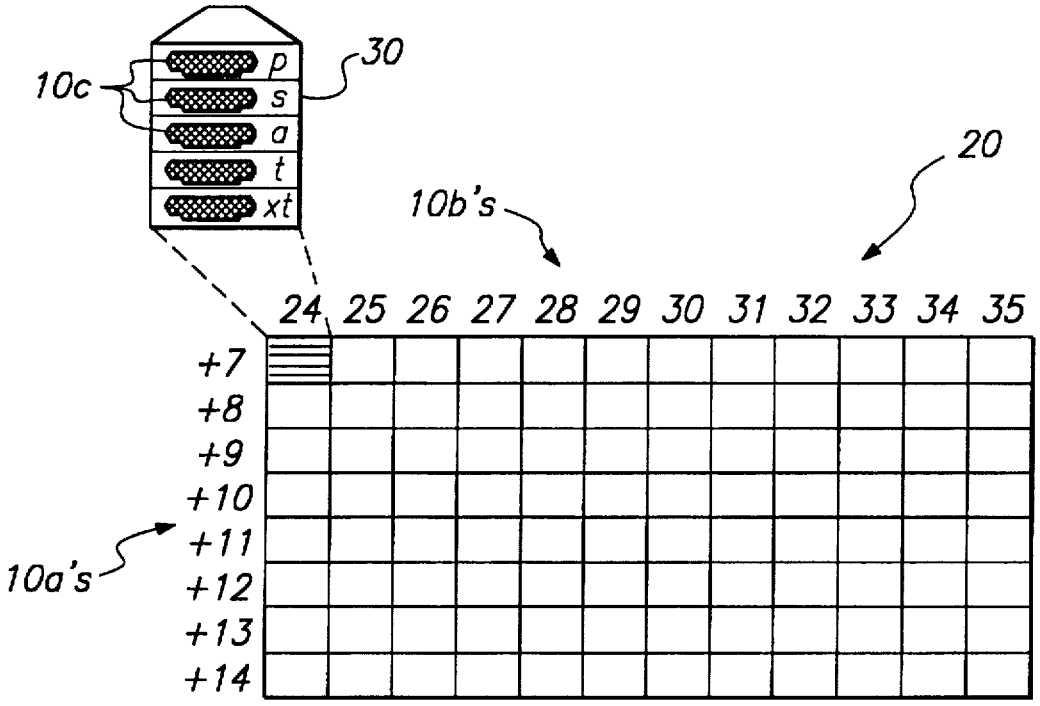
FIG. 3 is a front view of a series of shelves containing try-on apparel.

Turning now to FIG. 3, it can be seen that each cube 30 of shelves 20 contains five try-on apparel 10, all of which have the same hip 10*a* and waist 10*b* measurements, but each having a different rise 10*c* measurement. Thus, in this illustration of a preferred embodiment of the invention, nearly 500 different pairs of try-on apparel 10 are used to determine fit. In a preferred embodiment, for each waist, hip and rise combination, there are at least 9 possible inseam or hem lengths. Thus a matrix of several thousand different body dimension combinations or sizes is used to produce a finished apparel.

Figure 4:
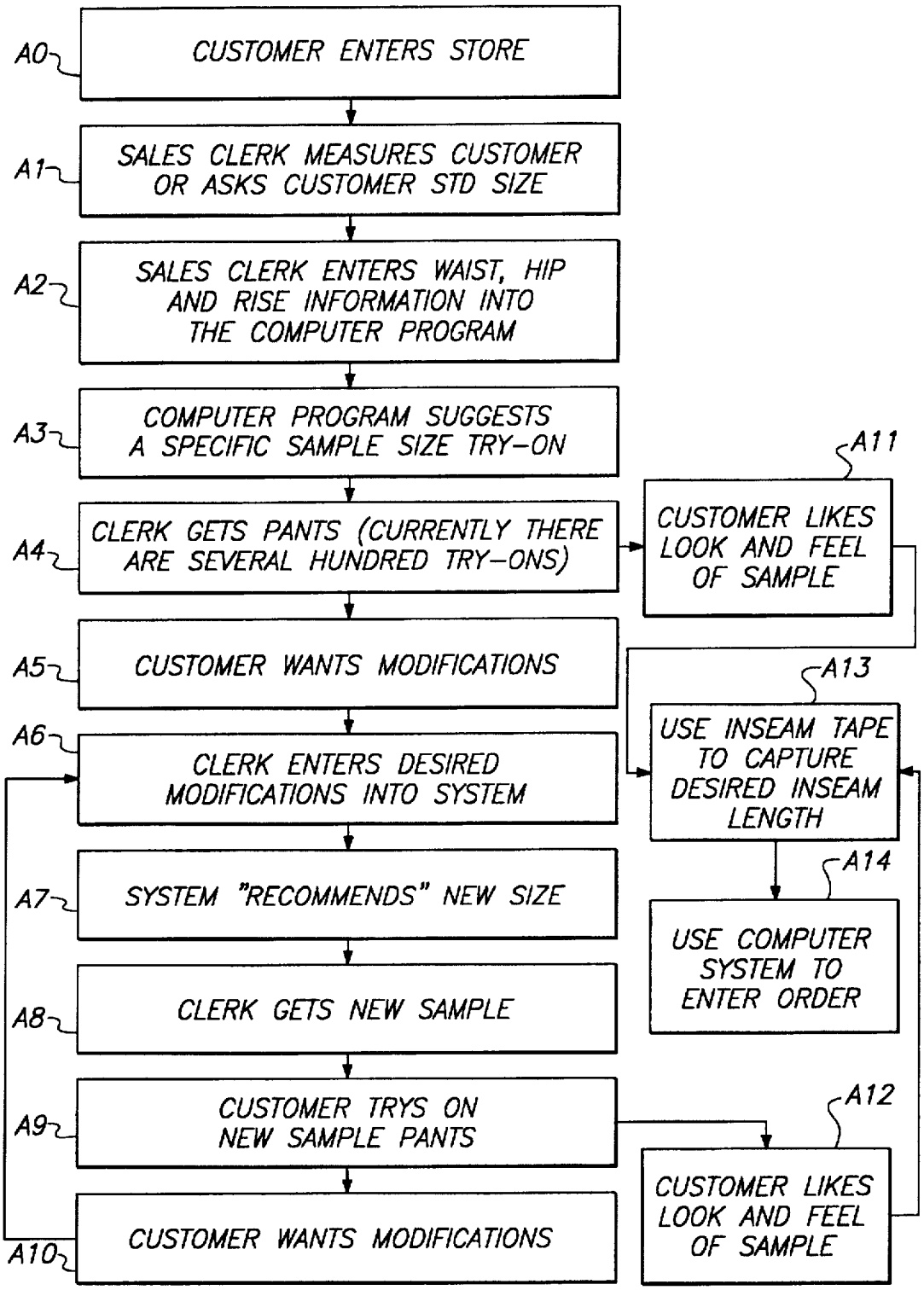
FIG. 4 is a flow diagram depicting the principal steps in the fitting process.

With reference now to FIG. 4, the method and apparatus used to determine fit are shown in a flow diagram of the process at a retail store. After a customer has entered the store, at Step A0, a sales clerk can measure the customer at step A1 or alternatively, ask the customer his or her standard size. Next, at step A12, the customer's hip 10*a*, waist 10*b*, and rise 10*c* information is entered into the system, using the data collected from the customer. At step A3, the system will suggest a specific try-on apparel 10 to try on. In the situation where there are several hundred or thousands of try-ons, the clerk typically gets the specific try-on apparel 10 suggested by the system shown here as step A4. After the customer tries this try-on apparel 10, if he or she likes the fit and feel of try-on apparel 10 as indicated at step A11, the clerk proceeds to step A13 to capture information about hem lengths or inseam tape measurements and then enters an order into the system at step A14.

Still in FIG. 4, if the customer wants modifications, as illustrated at step A5, such as a looser waist or hips or a higher or lower rise, these modifications are indicated to the system at step A6 by the clerk. Using predetermined rules the system recommends at step A7, a new try-on apparel 10 to try, having dimensions that more closely approximate those indicated as desirable. The clerk gets the new try-on apparel 10 at step A8, and customer tries that on at step A9. If the customer likes the fit and feel of that try-on apparel 10 (step A12), steps A13 and A14 are taken. If not, and the customer wants additional modifications, as shown at step A10, steps A6 through A10 are repeated until the customer either approves a try-on apparel 10, or decides not to purchase (DNP).

Figure 5:
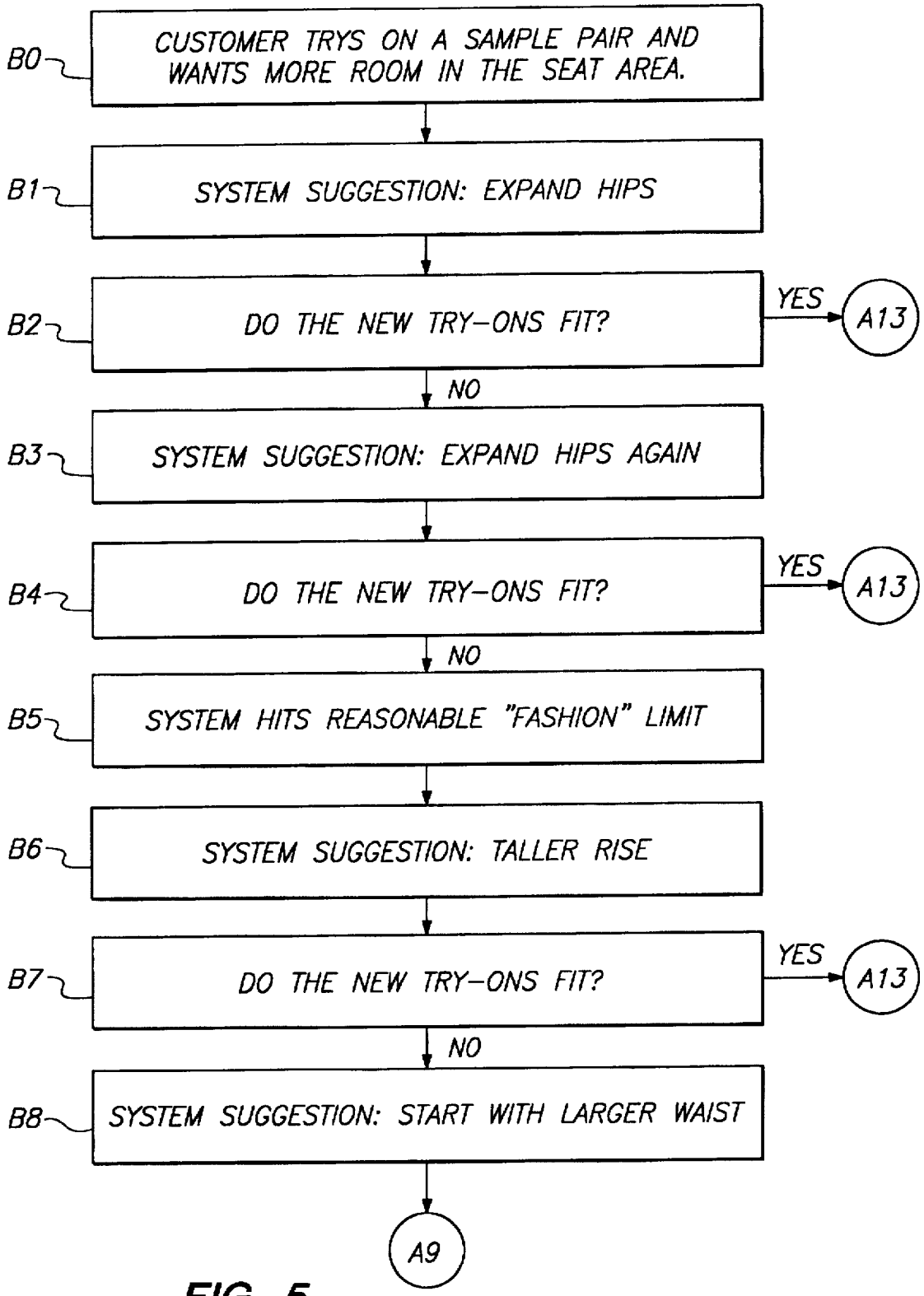
FIG. 5 is a flow diagram illustrating detailed steps of part of the fitting process.

In FIG. 5, a more detailed view of the operation of some of the steps of the present invention is shown in a flow diagram. Here, at step B0, a customer has tried on a try-on apparel 10 that is a pair of pants and wants more room in the seat area. Using pre-determined rules, the system suggests expanding hip 10*a* measurements at step B1. If this new try-on apparel 10 fits (Step B2), the clerk proceeds to step A13 in previous FIG. 4 to collect additional information.

Back in FIG. 5, if the new try-on apparel 10 does not fit, the system suggests expanding hip 10*a* measurements again and will suggest yet another try-on apparel 10, having these new dimensions at step B3. At step B4, the fit of this try-on apparel 10 is checked. If it does not fit, the system proceeds to step B5 to see if there is a reasonable fashion limit. For example, while hundreds or thousands of garments can be defined by the present invention, a particular manufacturer may decide that it is not economically feasible to try to sell garments having certain dimensions. These fashion limits can be included in the system. The system may suggest an alternate set of try-on apparel 10 such one having a taller rise 10*c*, as indicated at step B6. It is possible that or a larger waist 10*b*, as could be suggested at step B6, might suggest a try-on apparel 10 that will fit the customer but stay within the fashion limits imposed by the manufacturer. If the new try-on apparel 10 fits, (Step B7) the system instructs the clerk to go to Step A13. If not, another suggestion may be made at step B8, namely start with a larger waist.

Figure 6:
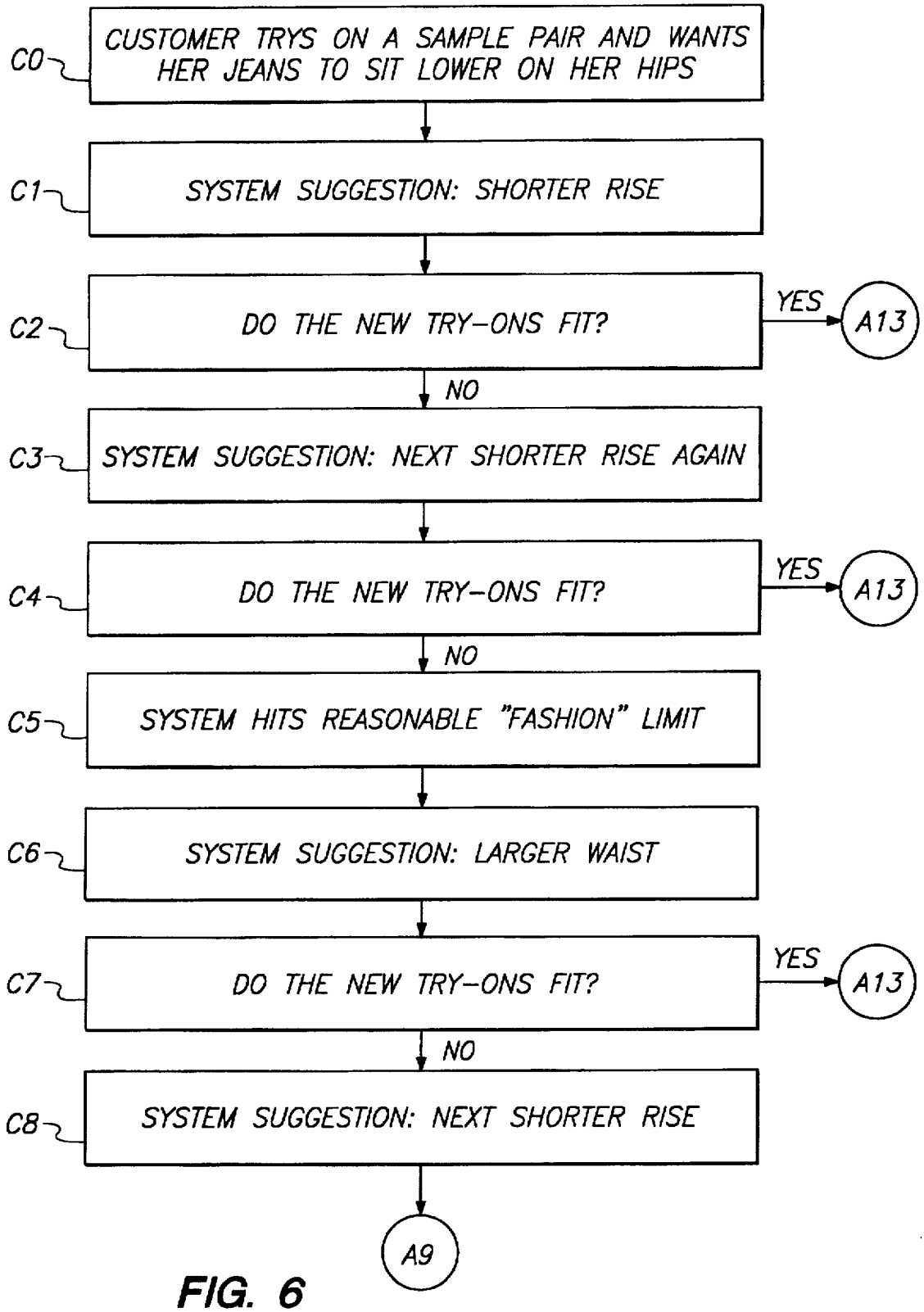
FIG. 6 is a flow diagram showing another example of a possible detail step of the fitting process.

In FIG. 6, another set of variations in the process is shown in which the customer wants her jeans to sit lower on her hips (step C0). The present invention will suggest a shorter rise, first at Step C1, and continue until a fashion limit is reached at step C5. If the try-on apparel 10 still does not fit, the system will suggest a larger waist, as shown at Step C6. Processing continues until a fit is approved or the customer decides not to purchase.

With reference now to FIG. 7, an overall flow diagram of the logic of a preferred embodiment is shown. Assuming the customer tries on a pair of try-on apparel 10 at step D0, the system checks for fit at D1. If that try-on apparel fits, and the customer wants to order, the order is taken at step D2. If that apparel does not fit, the system checks to see if the waist dimension was approved by the customer at D3. If not, a next check is made to see if a waist fashion limit has been reached at step D4. If yes, the system will check to see if either a different hip 10*a* or rise 10*c* suggestion is possible at step D5. If so, a different try-on apparel 10 will be suggested. If not, no other options appear possible and the system proceeds to DB to collect did not purchase information at step 16.

Note that as the system determines that options are no longer available in one or more of the dimensions, these choices are disabled so that the user cannot select them.

Still in FIG. 7, if a waist limit was not reached, the processing proceeds to Step D7, to see if the hip 10*a* dimensions were approved. Processing similar to that described for the waist dimensions takes place at steps D8, D9 and D10. If dimension choices are still possible, the system will ask if the rise 10*c* of the currently try-on apparel 10 is approved at Step D11. If not, limits and remaining choices are checked at steps D12 and D13. The system continues to disable those options that it has determined are no longer available. Finally, still in FIG. 7 at Step D15, the system checks to see if any dimension options can still be suggested, if a try-on apparel 10 has still not been approved. If some remain, the system proceeds to step D17, to suggest one and the customer may try that one.

Figure 8:
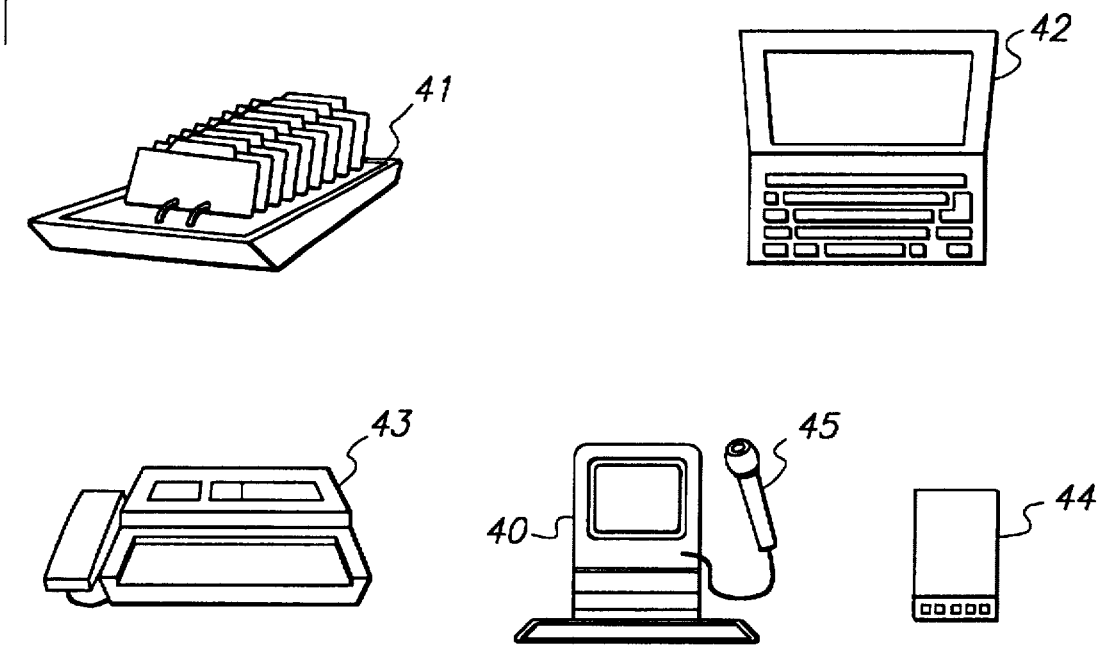
FIG. 8 is an illustrative front perspective view of some possible embodiments of a system constructed according to the present invention.

Turning now to FIG. 8, it will be apparent to those skilled in the art that the method and apparatus of the present invention can be implemented in a variety of ways. For example, a manual system might use a cardfile 41, together with an instruction manual or sheet to go through the logic illustrated in the previous figure. Alternatively, an electronic device 42, such as a dedicated palmtop device similar to a pre-programmed electronic calculator could be used. Either of these might be used in conjunction with a fax machine 43 or a modem 44 to convey the fit information to a manufacturing system.

Still in FIG. 8, a voice-activated system or device 45 could be connected to a computer system 40 to implement the invention.

Figure 9:
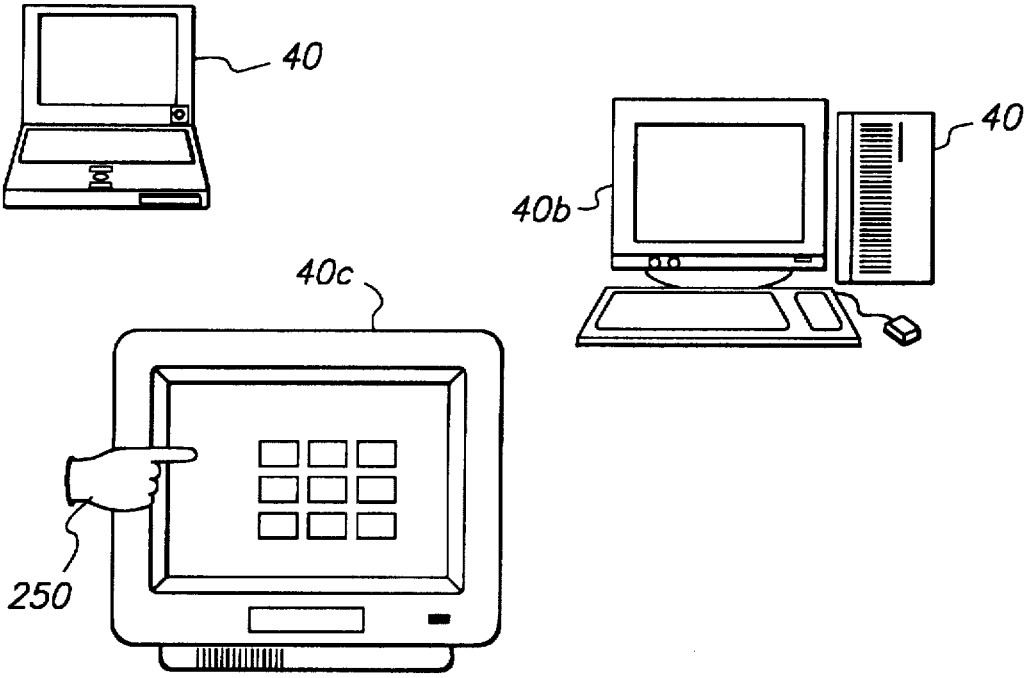
FIG. 9 is a front perspective view illustrating some types of input devices.

Turning now to FIG. 9, a preferred embodiment of the present invention using an interactive touchscreen 40*c* is shown. A simpler display device 40*b* could also be used with a keyboard. In a preferred embodiment a touchscreen 40*c* is coupled to a system 40 and a keyboard. In a preferred embodiment, an industry standard personal computer system is used with a touch sensitive display and keyboard. The personal computer is programmed in Visual Basic to create the easy to use interface, but as will be apparent to those skilled in the art, any of a number of computer systems such as laptops, mainframes, mini-computers, parallel processors, neural nets and so on could be used. Similarly, any of a number of programming languages exist which permit one to create a graphical user interface or a voice interface or other interface that is simple and easy for either a clerk or a customer to use. A preferred embodiment stores and accesses the dimension information in a matrix or table to access it. The logic flows depicted above can be implemented in any of a number of ways to access such information, including software, firmware, hardware and so on.

Figure 10:
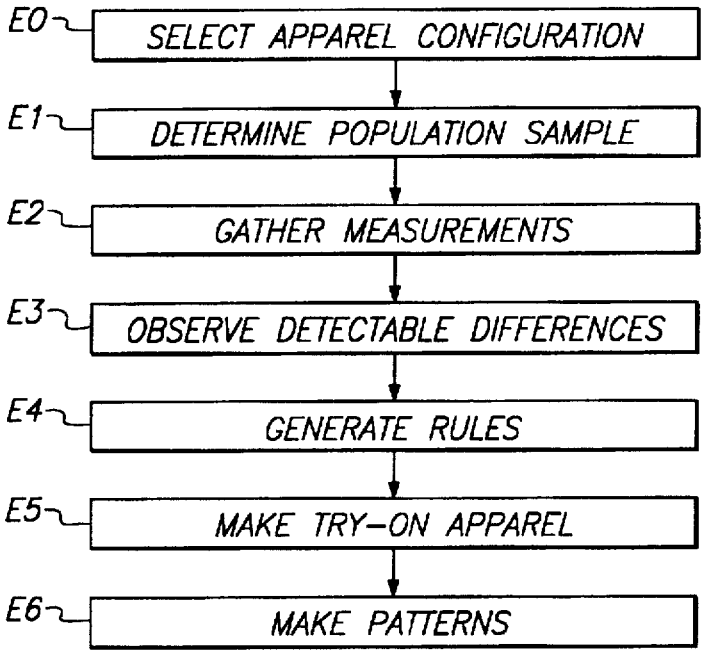
FIG. 10 is a flow diagram of the steps used to determine the dimensions to use to construct try-on apparel, the number to make and the rules for trying them.

With reference now to FIG. 10, the method used by the present invention to determine quantities and dimensions of try-on apparels 10 is shown. The flow diagram indicates that an apparel design and configuration is chosen at Step E0. In a preferred embodiment, this configuration is women's jeans. But it will be clear to those in the art that shirts, gloves, footwear or any other type of fitted apparel could be selected.

Next, at Step E1, a population sample is chosen. The size of this will depend on the type of apparel configuration selected. In a preferred embodiment, approximately 1300 individual measurements were used. At Step E2, these measurements are gathered either from individuals who are being measured for the first time, or, if any databases exist that may be relevant, from those.

In a preferred embodiment, actual measurements are taken from at least a subset of the sample, so that an expert can observe what differences in dimensions these individuals are likely to detect. For example, in a preferred embodiment, it was found that women who tried on jeans of different dimensions, were usually not able to detect differences of less than an inch in waist 10*b* or hip 10*a* dimensions. However, most women measured were able to detect differences as small as half an inch for rise 10*c* dimensions. These observations are made at Step E3 and used in Step E4, together with any relevant information about fashion limits to generate rules for selecting try-on apparels 10 at Step E4. The information is also used to decide at Step E5 how many try-on apparels 10 to make, and at Step E6, how many patterns, if any.

It should be noted that while patterns are used with the try-on apparels 10 in a preferred embodiment, it is possible that other apparel such as molded or formed try-on apparels 10 may not require patterns.

Figure 11:
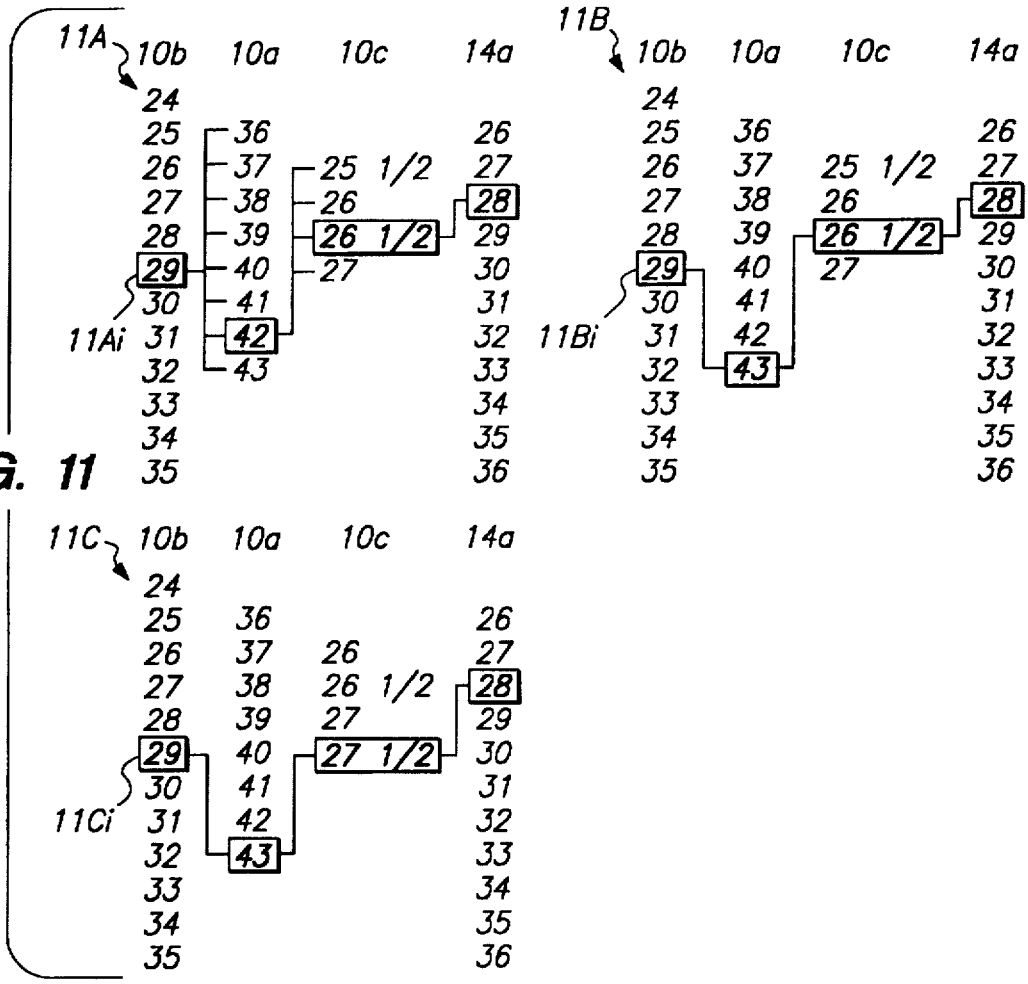
FIG. 11 shows three examples of dimensions considered in a hypothetical fitting.

Now turning to FIG. 11, an illustration is given of the selection process according to the method and apparatus of the present invention. In charts 11A, 11B and 11C, waist 10*b*, hip 10*a* and rise 10*c* dimensions for a pair of jeans are shown, together with possible inseam or hem lengths 14*a*.

The examples shown in FIG. 11 are the ones illustrated from the perspective of the clerk operating a device associated with the system in the following FIGS. 12 through 17.

Figure 12:
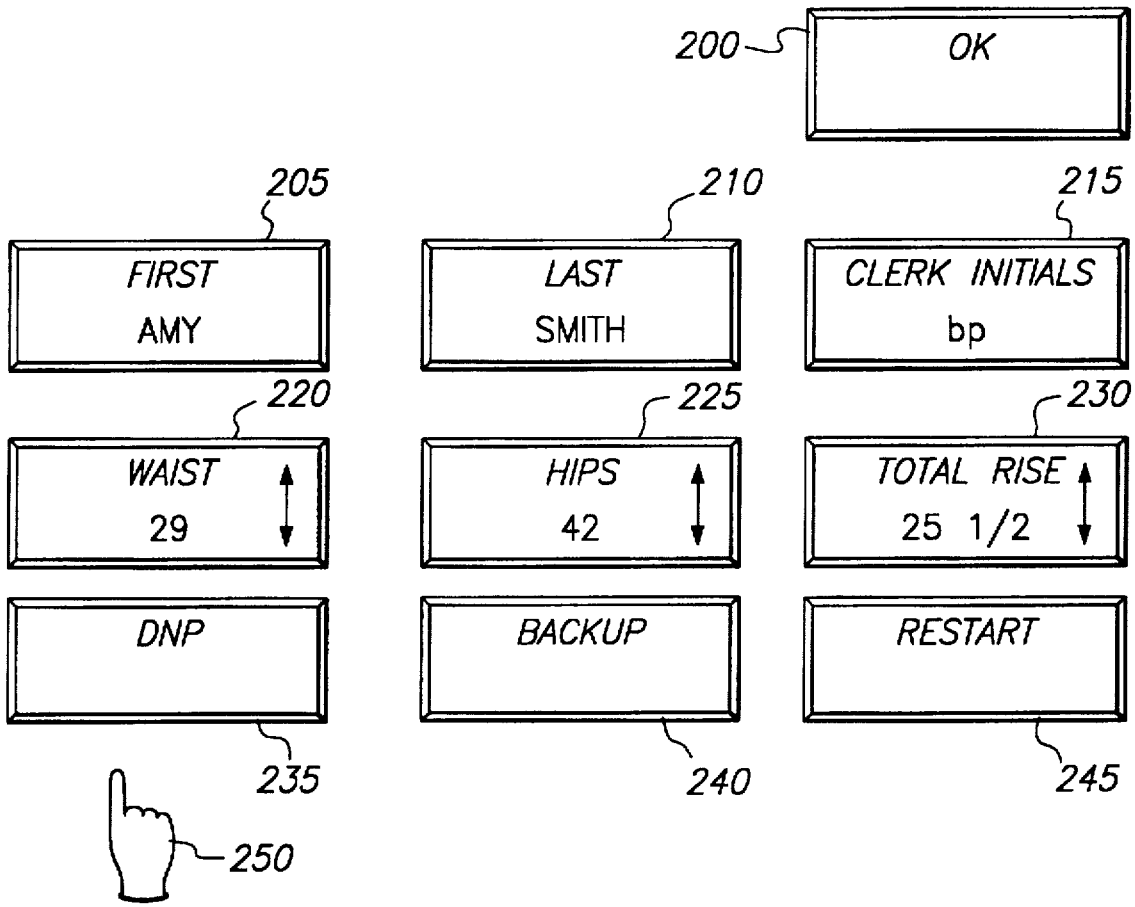
FIG. 12 is a schematic view of a touchscreen interface of a device used to collect fit information according to the present invention, depicting a beginning screen.

Turning to FIG. 12, where a touchscreen of a preferred embodiment is shown, a number of "button" options are depicted. Buttons 205, 210 and 215 indicate the clerk has entered a prospective buyer's name (Amy Smith) and the clerk's initials (bp).

In one preferred embodiment of the invention, the clerk measures the customer and enters her dimensions, here shown as Button 220 with a waist value of 29, Button 225 with a hip measure of 42 and Button 230 with a rise of 25½.

Button 235 can be used to indicate the customer did not purchase anything. Button 240 can be selected to backup to a previous screen and Button 245 can be used if the clerk wishes to restart.

Figure 13:
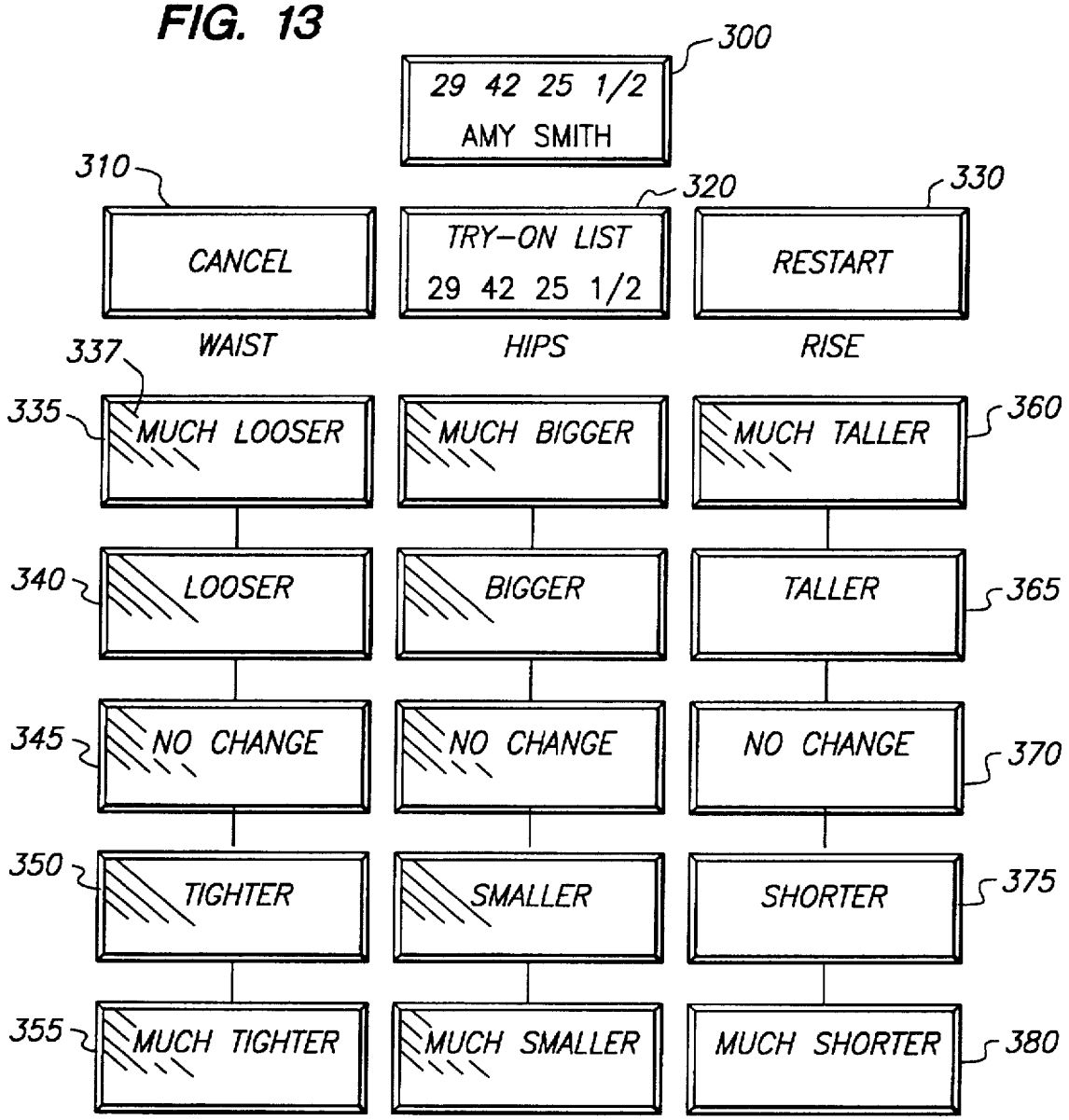
FIG. 13 is a schematic view of a touchscreen interface of a device used to collect fit information according to the present invention, depicting a screen showing options eliminated by a prospective buyer's fit responses.
Figure 14:
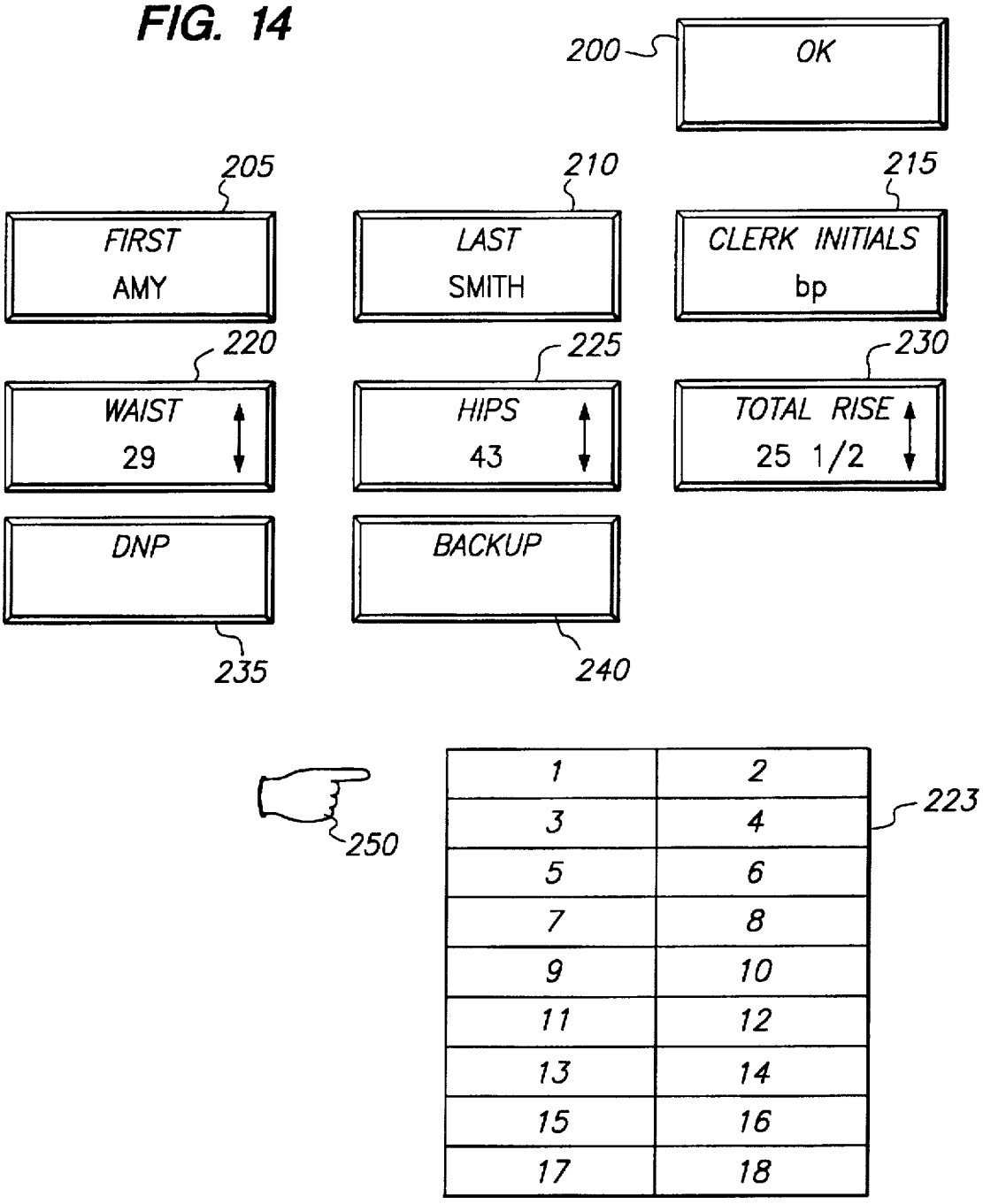
FIG. 14 is a schematic view of a touchscreen interface of a device used to collect fit information according to the present invention, depicting an alternative way of entering initial dimensions information.

Now in FIG. 13, a screen is shown with Button 300 displaying the measurements taken for the customer and a try-on apparel 10 list 320, showing a try-on apparel 10 that has been suggested. (FIG. 14 shows an alternate way of entering dimensions if no measurements are taken. Either the clerk or the prospective buyer can enter the buyer's standard size from a table 223. The size chosen is translated by the system into the dimensions of a try-on apparel 10 to suggest.

Returning to FIG. 13, buttons having shaded portions 337 are shown. These dimension options or choices have been disabled by the system, after the customer has reported that some of the dimensions do not fit. Those Buttons 360–380 that have no shaded portion, are the remaining options.

Figure 15:
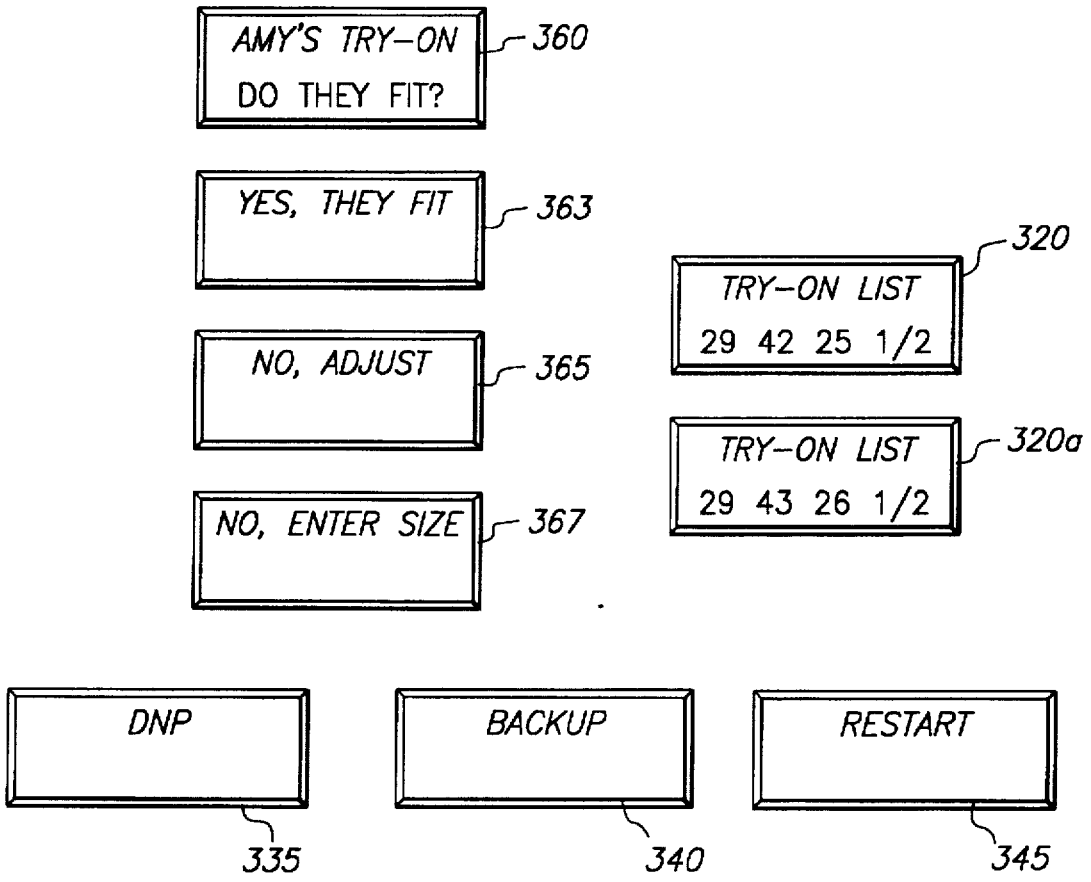
FIG. 15 is a schematic view of a touchscreen interface of a device used to collect fit information according to the present invention, depicting the results from two try-ons.
Figure 16:
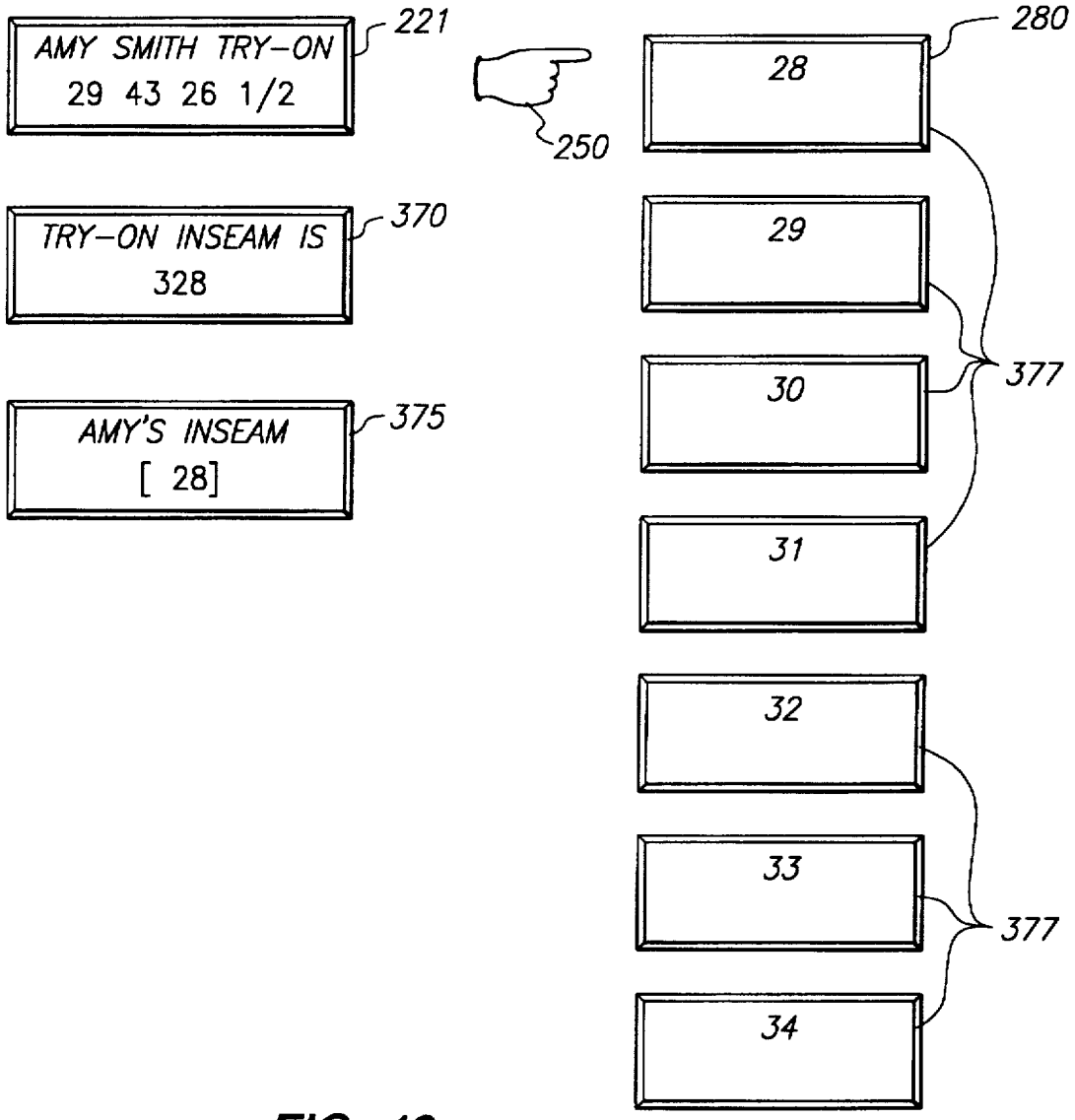
FIG. 16 is a schematic view of a touchscreen interface of a device used to collect fit information according to the present invention, depicting hem length options of a selected try-on apparel.

FIG. 15 shows the screen options presented after a try-on apparel 10 has been tried. FIG. 16 illustrates incorporating the inseam or hem length measurements, after a try-on apparel 10 has been selected. Here, the customer wants inseam 28 in Button 280.

Figure 17:
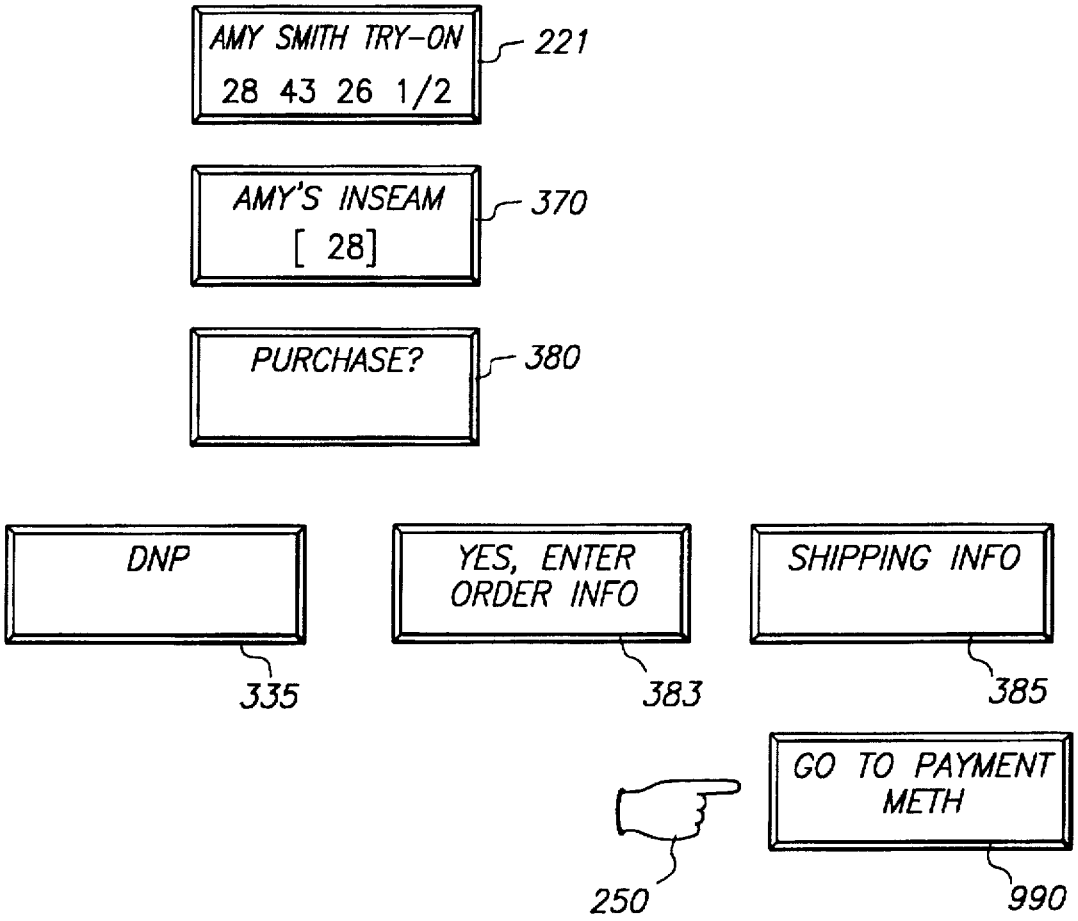
FIG. 17 is a schematic view of a touchscreen interface of a device used to collect fit information according to the present invention, depicting final approval and purchase options.

FIG. 17 shows a screen that can be used after all dimensions have been approved. If the customer wants to order, Button 383 is pressed, to call up order information screens, if desired. Button 385 can be used to call up screens for shipping information for use by the manufacturing system.

And, still in FIG. 17, payment methods can be selected at Button 990.

Figure 18:
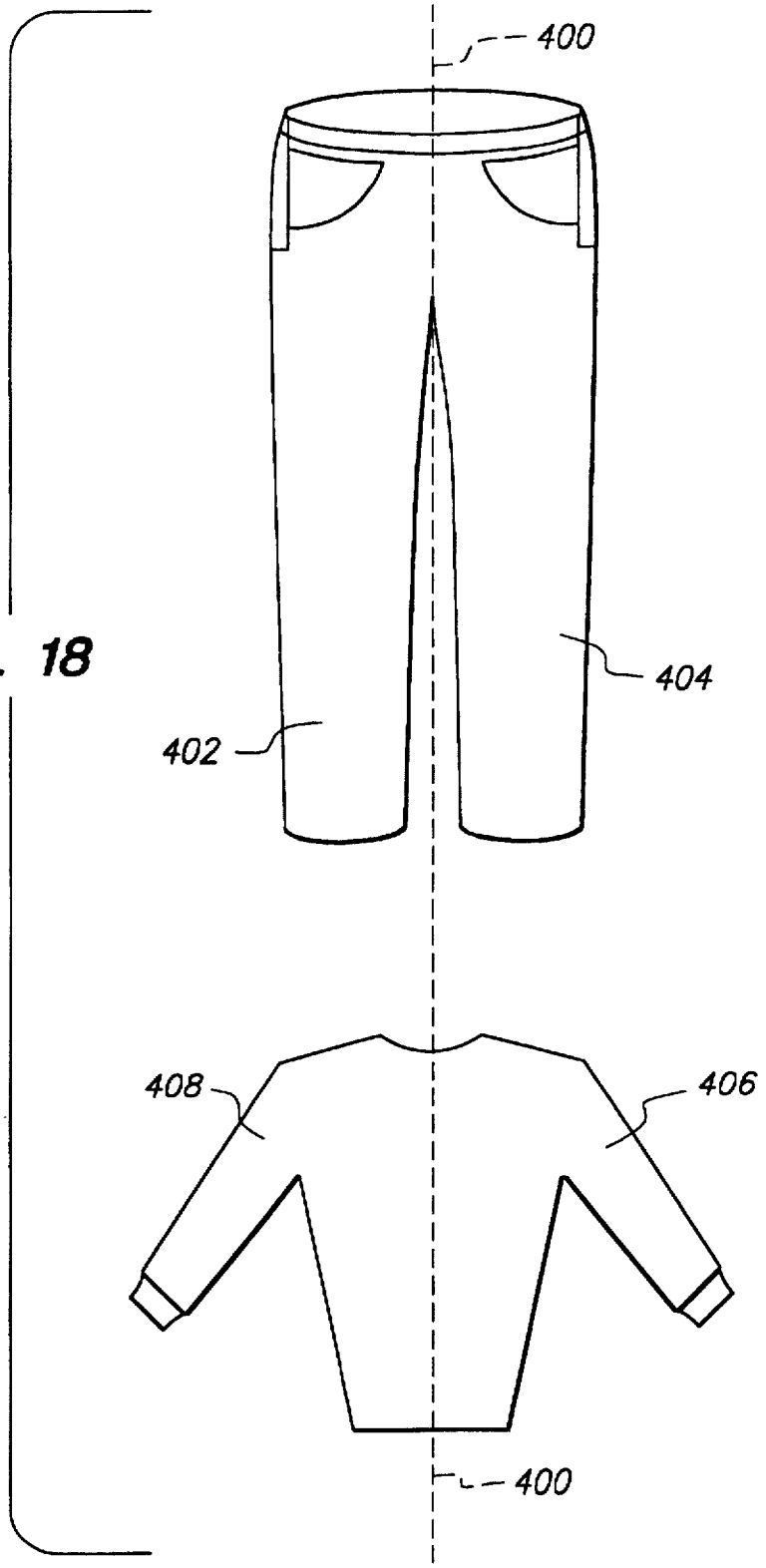
FIG. 18 is a view of hybrid try-on garments of the present invention.

The system described above can be easily adapted to a wide variety of garment styles and finishes without having to provide try-on garments for each style and finish. The customer can express preference as to two different styles with the same number of try-on garments used for a single style, by providing hybrid try-on garments wherein the garment is divided into two halves, preferably along a bilateral or symmetrical axis 400 as shown in FIG. 18, so that one-half of the try-on garment is one style and the other half of the try-on garment is another style. The customer can then locate the best fit and adjust for length as described above, and then view themselves in the mirror on one side for the first style, and then on the other for the second style, and choose between them. For example, jeans can come in a variety of styles including a tapered leg style, and an over-the-boot style. To enable a customer to visualize how they will look in both styles, hybrid try-on garments can be constructed as shown in FIG. 18 which have one tapered leg 402 and one flared over-the-boot leg 404. Likewise, a hybrid try-on shirt could be constructed having one normal sleeve 406 and a full sleeve 408. When the best fitting try-on garment is located using the method described in detail above, and the inseam is adjusted for length, the customers can view themselves in a mirror to select which of the two different styles they prefer.

A variety of fabrics can also be selected by the customer once fit has been achieved. However, it is well known that different fabrics exhibit different shrinkage characteristics, depending upon manufacturing variables, including dye type, finish type, type of weave, and type of yarn. Denim, for example, is particularly susceptible to shrinkage. Accordingly, patterns must take into account the shrinkage which is normally expected for a particular fabric and finish. It would be very time consuming and expensive to create a grid of patterns for each type of fabric selectable by a customer. Accordingly, we believe it would be preferable to create a grid of base patterns which are annotated with pattern points which can be adjusted after fit is achieved and the pattern corresponding to the selected try-on garment is identified. Thus the pattern can be scaled to compensate for subsequent shrinkage known to occur when the sewn garment goes through the finishing process, for example, stone washing, bleaching, dying or the like to produce the desired finish. Any conventional pattern scaling program can be used to scale the base patterns to compensate for shrinkage.

Those skilled in the art will appreciate that the embodiments described above are illustrative only, and that other systems in the spirit of the teachings herein fall within the scope of the invention.

We claim:

1. A try-on apparel for use with a plurality of other try-on apparel, each of which differ from the others in at least one critical dimension, and a custom tailoring and manufacturing system having a means for storing predetermined apparel patterns, each try-on apparel corresponding to a unique predetermined apparel pattern stored in the custom tailoring and manufacturing system, said try-on apparel comprising:

a plurality of workpieces of predetermined dimensions cut according to a unique predetermined pattern, and sewn together and finished to form a try-on apparel, said try-on apparel having critical dimensions of predetermined size which differ in at least one critical dimension from each of the plurality of other try-on apparel; and, a marking placed on said try-on apparel to identify the critical dimensions of said try-on apparel, to distinguish it from said plurality of other try-on apparel, and to link said try-on apparel to the corresponding unique garment pattern stored in the custom tailoring and manufacturing system.

2. The try-on apparel of claim 1 additionally including a variable dimension and a measuring device attached along said variable dimension for measuring the variable dimension after it has been adjusted to a customer's preference.

3. The try-on apparel of claim 2 wherein said variable dimension is selected from the group consisting of inseam length, sleeve length, and hem length.

4. The try-on apparel of claim 2 additionally including a means for adjusting and securing the variable dimension in a desired position for measuring.

5. The try-on apparel of claim 4 wherein said means for securing is a hook-and-pile type fastener.

6. The try-on apparel of claim 1 wherein the apparel has a bilateral axis forming a first half and a second half of said try-on apparel, said first half constructed in a first style and said second half constructed in a second style, said first style being different from said second style.

7. The try-on apparel of claim I wherein the dimensions of said workpieces are calculated using a conventional scaling system along with a two step process in which a key grade point is held constant and the remaining dimensions are normally graded to form a base pattern followed by normal scaling of the base pattern to form a pattern for the workpieces used to construct the try-on apparel.

8. An apparatus for custom tailoring and manufacturing apparel of a selected design and configuration, comprising:

a plurality of substantially finished try-on apparels, each try-on apparel having pre-determined dimensions differing from the dimensions of each other try-on apparel;

a system for storing and accessing said pre-determined dimensions of each of said try-on apparels, for entering critical dimensions from a prospective buyer, said critical dimensions predetermined by the type of try-on apparel, for identifying try-on apparel to be tried on by the prospective buyer based upon said prospective buyer's critical dimensions and preferences, for collecting the relative fit information of each try-on garment actually tried on by the prospective buyer and for reporting final approved pre-determined dimensions for manufacturing.

9. The apparatus of claim 8 additionally comprising a measuring device for initially capturing the critical dimensions from the prospective buyer.

10. The apparatus of claim 9 wherein said measuring device is linked to, and automatically communicates with, said system.

11. The apparatus of claim 8 wherein each try-on apparel is marked to distinguish it from every other try-on apparel.

12. The apparatus of claim 11 wherein each try-on apparel is marked with a bar code.

13. The apparatus of claim 8 wherein each try-on apparel has a first half and a second half, said first half constructed in a first style and said second half constructed in a second style, said first style being different from said second style.

14. The apparatus of claim 8 wherein each try-on apparel includes a variable dimension adjustable on the prospective buyer after an acceptable fit has been obtained for all other critical dimensions, and a measuring device incorporated into the try-on apparel for measuring the variable dimension after the try-on apparel has been adjusted to the prospective buyer's preference.

15. The apparatus of claim 14 wherein said variable dimension is selected from the group consisting of inseam length, sleeve length, and hem length.

16. The apparatus of claim 8 wherein said predetermined dimensions of each try-on apparel comprise a pattern corresponding to each try-on apparel.

17. The apparatus of claim 16 additionally including a means for scaling said patterns, and data for controlling the scaling means.

18. The apparatus of claim 17 wherein said data relates to the expected shrinkage which the apparel will undergo depending upon the fabric and finish which the prospective buyer selects, said scaling means responsive to said data for scaling said patterns to compensate for shrinkage of the selected fabric during finishing.

19. The apparatus of claim 8 additionally including a means for transmitting data relating to an accepted try-on apparel to a manufacturing facility for use in manufacturing the selected apparel.

20. The apparatus of claim 19 wherein said data is received by a cutting machine for cutting fabric workpieces for constructing said apparel.

* * * * *